United States Patent [19]

Kanai

[11] Patent Number: 4,661,427

[45] Date of Patent: Apr. 28, 1987

[54] AMORPHOUS SILICON PHOTOCONDUCTIVE MEMBER WITH REDUCED SPIN DENSITY IN SURFACE LAYER

[75] Inventor: Masahiro Kanai, Tokyo, Japan

[73] Assignee: Canon Kabushiki Kaisha, Tokyo, Japan

[21] Appl. No.: 815,129

[22] Filed: Dec. 30, 1985

Related U.S. Application Data

[63] Continuation of Ser. No. 632,878, Jul. 20, 1984, abandoned.

[30] Foreign Application Priority Data

Jul. 27, 1983 [JP] Japan ..... 58-137135

[51] Int. Cl.[4] ..... G03G 5/14

[52] U.S. Cl. ..... 430/57; 430/62; 430/66; 430/84; 430/95

[58] Field of Search ..... 430/57, 84, 85, 86, 430/95, 62, 66

[56] References Cited

U.S. PATENT DOCUMENTS 4,460,669 7/1984 Ogawa et al. ..... 430/57

4,490,454 12/1984 Misumi et al. ..... 430/57

*Primary Examiner*—John L. Goodrow

*Attorney, Agent, or Firm*—Fitzpatrick, Cella, Harper & Scinto

[57] ABSTRACT

A photoconductive member, having a support and a photoconductive light receiving layer comprising a matrix of silicon atoms containing at least one of hydrogen atoms and halogen atoms provided on said support, said light receiving layer having a layer region with a layer thickness of at least 20 Å from the side of the free surface, in which the spin density measured by Electron Spin Resonance is $1.0\times10^{20}$ spins/cm$^3$ or less.

17 Claims, 3 Drawing Figures

AMORPHOUS SILICON PHOTOCONDUCTIVE MEMBER WITH REDUCED SPIN DENSITY IN SURFACE LAYER

This application is a continuation of application Ser. No. 632,878 filed July 20, 1984, now abandoned.

BACKGROUND OF THE INVENTION

1. Field of the Invention

This invention relates to a photoconductive member having sensitivity to electromagnetic waves such as light [herein used in a broad sense, including untraviolet rays, visible light, infrared rays, X-rays, gamma-rays, and the like].

2. Description of the Prior Art

Photoconductive materials constituting photoconductive layers in solid state image pick-up devices or in the field of image formation, for electrophotographic image-forming members or manuscript reading devices, are required to have a high sensitivity, a high SN ratio [Photocurrent ($I_p$)/Dark current ($I_d$)], spectral characteristics matching to those of electromagnetic waves to be irradiated, a rapid response to light, a desired dark resistance value as well as safety to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid safety characteristic is very important.

From the standpoint as mentioned above, amorphous silicon [hereinafter referred to as a-Si]has recently attracted attention as a photoconductive material. For example, DE-OS Nos. 2746967 and 2855718 disclose its applications for use in image forming members for electrophotography, and DE-OS No. 2933411 its application for use in a photoelectric converting reading device.

However, under the present situation, photoconductive members having photoconductive layers of a-Si of the prior art are further required to be improved in overall characteristics, including electrical, optical, and photoconductive characteristics such as dark resistance value, photosensitivity, and responsiveness to light, and use environment characteristic such as humidity resistance, and further in stability with lapse of time.

For example, when a-Si is applied to an image forming member for electrophotography, if it is attempted to obtain higher photosensitivity and higher dark resistance, there may occur generation of residual image due to residual potential during repeated uses over a long time, namely the so-called ghost phenomenon. Further, since the surface of the photoconductive layer is subjected continually to chemically and physically severe conditions such as corona charging, friction with toner and paper or cleaning with blade, whereby vital image defects may sometimes be formed as the change with lapse of time.

Further, when a photoconductive layer is made of a-Si material, in order to improve its electrical and photoconductive characteristics, hydrogen atoms or halogen atoms such as fluorine atoms or chlorine atoms, and in order to control the conductivity type, boron atoms or phosphorus atoms, or in order to improve other characteristics, other atoms are incorporated as the constituent atoms in the photoconductive layer. However, depending on the mode in which these constituent atoms are contained, there may sometimes occur problems in electrical and photoconductive characteristics.

In particular, in the layer region at the outermost surface of the photoconductive layer, dangling bonds are liable to be formed during manufacturing process depending on the content of the contained atoms and their distribution. For this reason, the problems of behavior of charges variously changed and structural stability are very important. It is frequently determined by the number of dangling bonds in the layer region at the outermost surface of the photoconductive layer whether the photoconductive member can exhibit the function as desired.

On the other hand, when a photoconductive member is prepared as an image forming member for electrophotography according to the method conventionally known in the art, there have been various problems. For example, due to insufficient life of photocarriers generated by irradiation of light in the photoconductive layer formed within said layer, sufficient image density could not be obtained, or in the case of greater dosage of image exposure, excessive photocarriers formed in the vicinity of the surface of the photoconductive member may be propelled in the lateral direction. Further, injection of charges from the support side could not sufficiently be impeded, whereby the images tended to be unclear.

Therefore, when a photoconductive member is made of an a-Si material, it is necessary to provide a photoconductive layer having the electrical and optical characteristics as mentioned above and a chemically and physically stable surface protective layer while maintaining these characteristics, and high quality images can be obtained for a long time with such a layer structure.

SUMMARY OF THE INVENTION

In view of the above points, the present invention contemplates the achievement obtained as a result of extensive studies made comprehensively from the standpoints of applicability and utility of a-Si as a photoconductive member for electrophotographic image-forming members, solid stage image pick-up devices, reading devices, etc. It has now been found that a photoconductive member having a photoconductive layer, made of so-called hydrogenated amorphous silicon, halogenated amorphous silicon or halogen-containing hydrogenated amorphous silicon which is an amorphous material containing at least one of hydrogen atom (H) and halogen atom (X) in a matrix of a-Si [hereinafter referred to comprehensively as a-Si(H,X)], said photoconductive member being prepared by designing so as to have a specific layer structure as hereinafter described, is found to exhibit not only highly excellent characteristics in practice but also to surpass the photoconductive members of the prior art in substantially all respects, especially having markedly excellent characteristics as a photoconductive member for electrophotography.

An object of the present invention is to provide an electrophotographic photoconductive member which can easily give a high quality image which is high in density, clear in halftone, and high in resolution, being free from image defect and image flow.

Another object of the present invention is to provide a photoconductive member having electrical, optical, and photoconductive characteristics which are constantly stable and all-environment type with virtually no dependency on the environment under use, which member is markedly excellent in light fatigue resistance and also excellent in durability without causing deterioration phenomenon when used repeatedly, exhibiting no or substantially no residual potential observed.

Still another object of the present invention is to provide a photoconductive member having excellent electrophotographic characteristics, which has a sufficient charge retentivity at the time of charging treatment for formation of electrostatic charges to the extent such that a conventional electrophotographic method can be very effectively applied when it is provided for use as an image forming member for electrophotography.

Still another object of the present invention is to provide a photoconductive member having high photosensitivity, high SN ratio characteristic, and good electrical contact between the laminated layers.

Further, still another object of the present invention is to provide a photoconductive member, having a support and a photoconductive light receiving layer comprising a matrix of silicon atoms containing at least one of hydrogen atoms and halogen atoms provided on said support, said light receiving layer having a layer region with a layer thickness of at least 20 Å from the side of the free surface, in which the spin density measured by ESR (Electron Spin Resonance) is $1.0\times10^{20}$ spins/cm$^3$ or less.

The photoconductive member designed to have the layer structure of the present invention can overcome all of the problems as mentioned above and exhibit very excellent electrical, optical, and photoconductive characteristics as well as good environmental characteristics in use.

In particular, when it is applied to an image forming member for electrophotography, it is excellent in charge retentivity in charging treatment without any influence of residual potential on image formation at all, being stable in its electrical properties with high sensitivity and having high SN ratio whereby it is possible to obtain images of high quality with high density, clear halftone, and high resolution, and also excellent in light fatigue resistance, repeated use characteristics, particularly repeated use characteristics under a high humid atmosphere.

DETAILED DESCRIPTION OF THE PREFERRED EMBODIMENT

Referring now to the accompanying drawings, the photoconductive member of the present invention is to be described in detail.

Figure 1:
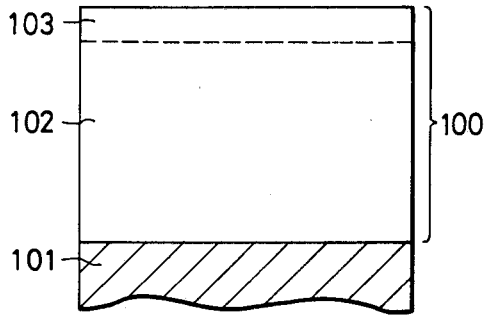
FIG. 1 and FIG. 2 each show a schematic sectional view for illustration of the layer structure of the photoconductive member according to the present invention.
Figure 2:
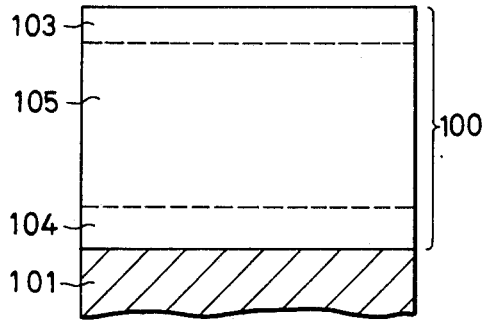

FIG. 1 and FIG. 2 show schematic layer structures for illustration of the layer structure of the photoconductive member of the present invention.

The light receiving layer 100 of the present invention has layer structures which can be classified broadly into two groups. One of them is the high resistance type light receiving layer, in which a photoconductive layer 102 with high resistance comprising primarily a-Si(H,X) and a surface layer 103 comprising primarily a-Si for protection of the photoconductive layer are provided on the support 101. The other is the charge injection impeding type light receiving layer, in which a charge injection impeding layer 104 comprising primarily a-Si(H,X) containing, for example, at least one atoms of boron, oxygen, nitrogen, carbon, etc. for the purpose of impeding charge injection and a photoconductive layer 105 comprising primarily a-Si(H,X) are formed in the layer thickness direction, and further a surface layer 103 comprising primarily a-Si for protection of these layers.

In either type of the layer structures, the surface layer 103 is characterized by containing atoms of silicon atoms and hydrogen atoms, and/or carbon atoms, nitrogen atoms, oxygen atoms, etc., and the concentration distribution of these atoms may be uniform with respect to the layer thickness direction and the direction parallel to the support surface, or alternatively the layer may have a distribution in which the concentration is decreased toward the support surface. The surface layer 103 may have a layer thickness preferably of 20 Å to 15 μm, more preferably 30 Å to 10 μm, most preferably 40 Å to 5 μm. The spin density in the surface layer 103 as measured by ESR should preferably be $1.0\times10^{20}$ spins/cm$^3$ or less, more preferably $1.0\times10^{19}$ spins/cm$^3$ or less, most preferably $1.0\times10^{18}$ spins/cm$^3$ or less.

As the atoms for imparting high resistance to the photoconductive layer 102, there may be included boron, oxygen, nitrogen, carbon, and the like, and the minimum concentration of these atoms in said photoconductive layer 102 may preferably be 1 to $1\times10^3$ atomic ppm, more preferably 50 to $5\times10^2$ atomic ppm, most preferably 100 to $5\times10^2$ atomic ppm. With such a content, the electrical resistance of said photoconductive member may be made about $10^{12}$ ohm$^{-1}$. cm$^{-1}$ or more in terms of dark resistance value.

Further, the maximum concentration of boron, oxygen, nitrogen, carbon, etc. to be contained in the charge injection impeding layer 104 for impeding charge injection may preferably be 30 to $5\times10^4$ atomic ppm, more preferably 50 to $5\times10^4$ atomic ppm, most preferably 100 to $5\times10^3$ atomic ppm. Said charge injection impeding layer 104 should have a layer thickness preferably of 20 Å to 15 μm, more preferably 30 Å to 10 μm, most preferably 40 Å to 5 μm.

The photoconductive layer 105 comprises primarily a-Si(H,X) and may or may not contain atoms such as boron, oxygen, nitrogen, and carbon as the third atom. The photoconductive layer 105 may have a layer thickness preferably of 1 to 100 μm, more preferably 1 to 80 μm, most preferably 2 to 50 μm.

Thus, when the photoconductive member having a surface layer containing at least one of atoms such as hydrogen, carbon, nitrogen, and oxygen and having a spin density as measured by ESR as specified above is used for an image forming member for electrophotography, it is possible to obtain visible images of high quality, which are particularly high in image density without occurrence of image flow even at greater image exposure dosage, clear in halftone and high resolution, for a long time. This may be considered to be probably because the surfaces of the light receiving layer made to be highly resistant and having provided a charge injection impeding layer can be protected from chemically and physically severe conditions such as corona charging, friction with toner and paper, or cleaning with blade, etc. to be improved in durability, and further because the surface layer has been improved in durability, and further because the surface layer has the electrical characteristics which will not lose the effects of the photoconductive layer as described above.

To explain in more detail, if the spin density as measured by ESR in the layer region with at least 20 Å layer thickness on the surface layer is $1\times10^{20}$ spins/cm$^3$ or less, dangling bonds will be reduced in the molecular structure in said surface layer, whereby a stable layer with low reactivity can be formed and a stable structure can be taken to improve sufficiently its hardness. Also, with respect to electrical characteristics, it is possible to obtain a dark resistance value of $10^{14}$ ohm$^{-1}$.cm$^{-1}$ and therefore very good charge acceptability can be accomplished.

In the present invention, the halogen atom (X) which may be incorporated in the light receiving layer may include fluorine, chlorine, bromine, and iodine. Particularly, chlorine and above all, fluorine may be mentioned as preferable ones. The atoms contained in the surface layer 103 may include boron, oxygen, nitrogen, and carbon. Particularly, boron and above all, carbon are preferred. Further, these atoms may be contained either singly or as a suitable combination.

The support to be used in the present invention may be either electroconductive or insulating. As the electroconductive support, there may be mentioned metals such as NiCr, stainless steel, Al, Cr, Mo, Au, Nb, Ta, V, Ti, Pt, Pd, etc. or alloys thereof.

As insulating supports, there may conventionally be used films or sheets of synthetic resins, including polyester, polyethylene, polycarbonate, cellulose acetate, polypropylene, polyvinly chloride, polyvinylidene chloride, polystyrene, polyamide, etc., glasses, ceramics, papers, and so on. These insulating supports may preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, $In_2O_3$, $SnO_2$, ITO ($In_2O_3+SnO_2$), and the like thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface.

The support may be shaped in any form as desired. For example, when the photoconductive member shown in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10 μm more from the points of fabrication and handling of the support as well as its mechnical strength.

In the present invention, formation of a light receiving layer comprising a-Si(H,X) may be conducted according to the vacuum deposition method utilizing discharging phenomenon, such as glow discharge method, sputtering method, or ion-plating method.

For example, for formation of the light receiving layer comprising a-Si(H,X) according to the glow discharge method, the basic procedure comprises introducing a starting gas for Si supply capable of supplying silicon atoms (Si) together with a starting gas for introduction of hydrogen atoms (H) and/or halogen atoms (X) and also a starting gas for introduction of boron, oxygen, nitrogen, and carbon atoms depending on the atom composition of the layer region to be formed together with an inert gas such as Ar, He, etc., it desired, into the deposition chamber which can be internally brought to a reduced pressure at a predetermined mixing ratio and gas flow rates, and forming a plasma atmosphere of these gases by exciting glow discharge in said deposition chamber, thereby forming a layer of a-Si(H,X) on the surface of a support set at a predetermined position.

Alternatively, for formation according to the sputtering method, a gas for introduction of hydrogen atoms (H) and/or halogen atoms (X) and also a starting gas for introduction of boron, oxygen, nitrogen, and carbon atoms depending on the atom composition of the layer region to be formed may be introduced into the deposition chamber for sputtering when sputtering a target of Si in an atmosphere of an inert gas such as Ar, He, or a gas mixture based on these gases.

The starting gas for supplying Si to be used in the present invention may include gaseous or gasifiable hydrogenated silicons (silanes) such as $SiH_4$, $Si_2H_6$, $Si_3H_8$, $Si_4H_{10}$, and others as effective materials. In particular, $SiH_4$ and $Si_2H_6$ are preferred with respect to easy handling during layer formation and efficiency for supplying Si.

In the present invention, for introduction of hydrogen atoms into the light receiving layer, it is generally practiced to supply a gas primarily of $H_2$ or hydrogenated silicon such as $SiH_4$, $Si_2H_6$, $Si_3H_8$, or $Si_4H_{10}$ as mentioned above into a deposition chamber and excite discharging therein.

Effective starting gases for introduction of halogen atoms to be used in the present invention may include a large number of halogenic compounds, as exemplified preferably by halogen gases, halides, interhalogen compounds, or gaseous or gasifiable silane derivatives substituted with halogens. Further, there may also be included gasous or gasifiable silicon compounds containing silicon atoms and halogen atoms as constitutent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_3$, $IF_3$, $IF_7$, ICl, IBr, etc.

As the silicon compounds containing halogen atoms, namely so-called silane derivatives substituted by halogens, there may preferably be employed silicon halides such as $SiF_4$, $Si_2F_6$, $SiCl_4$, $SiBr_4$, and the like.

As the starting gas when introducing halogen atoms into the light receiving layer, the halogen compounds or halo-containing silicon compounds as mentioned above may effectively be used. In addition, it is also possible to use gaseous or gasifiable halides containing hydrogen atom as one of the constitutents, including hydrogen halides such as HF, HCl, HBr, HI, etc., halo-substituted hydrogenated silicon such as $SiH_2F_2$, SiH- $_2I_2$, $SiH_2Cl_2$, $SiHCl_3$, $SiH_2Br_2$, $SiHBr_3$, etc. as effective starting materials for formation of light receiving layer.

These halides containing hydrogen atom can introduce hydrogen atoms which are very effective components for controlling electrical and photoelectric characteristics into the layer during formation of the light receiving layer, simultaneously with introduction of halogen atoms, and therefore they can be used as preferable starting materials for introduction of halogen atoms in the present invention.

The starting gas for supplying boron atoms to be used in the present invention may include $B_2H_6$, $B_4H_{10}$, $B_5H_9$, $B_5H_{11}$, $B_6H_{10}$, and the like.

The starting gas for supplying oxygen atoms to be used in the present invention may include $O_2$, NO, and $NO_2$.

As the starting gas for supplying nitrogen atoms to be used in the present invention, there may be employed gaseous or gasifiable nitrogen, nitrogen compounds such as nitrides or azides containing N as constituent atom such as nitrogen ($N_2$), ammonia ($NH_3$), hydrazine ($H_2NNH_2$), hydrogen azide ($HN_3$), ammonium azide ($NH_4N_3$), and the like. Further, as the compounds which can introduce also halogen atoms in addition to nitrogen atoms, halogenated nitrogen compounds such as nitrogen trifluoride ($F_3N$), nitrogen tetrafluoride ($F_4N_2$), and the like are also available.

The starting gas for supplying carbon atoms to be used in the present invention may include, for example, $CH_4$, $C_2H_4$, $C_3H_8$, $C_4H_{10}$, and the like containing C as constituent atoms. Otherwise, from the viewpoint of enabling deposition of a-Si:H layer at the same time in addition to introduction of carbon atoms, it is also possible to employ gaseous or gasifiable hydrocarbon-silicon such as $(CH_3)SiH_3$, $(CH_3)_2SiH_2$, $(CH_3)_3SiH$, $(CH_3)_4Si$, and the like.

For formation of the light receiving layer comprising a-Si(H,X) according to the reactive sputtering method or the ion plating method, for example, in the case of the sputtering method, a target comprising Si may be used and sputtering of this target is effected in a predetermined gas plasma atmosphere. Alternatively, in the case of the ion plating method, a polycrystalline silicon or monocrystalline silicon is placed as the vapor source in a vapor source boat, and the vapor source is vaporized by heating according to the resistance heating method or the electron beam method (EB method) to be permitted to be ejected and pass through a predetermined plasma atmosphere.

In either of the sputtering method and the ion plating method, introduction of desired atoms into the layer formed may be effected by introducing a gas for introduction of hydrogen atoms (H) and/or halogen atoms (X) together with a starting gas for introduction boron, oxygen, nitrogen, and carbon atoms depending on the atom composition in the region to be formed, containing also an inert gas such as He, Ar, etc., if desired, into the deposition chamber for sputtering or ion-plating and forming a plasma atmosphere of said gases.

For controlling the contents of hydrogen atoms, halogen atoms, boron atoms, oxygen atoms, nitrogen atoms, and carbon atoms for example, at least one of the amount of the starting material to be introduced into the deposition chamber for incorporation of hydrogen atoms (H), halogen atoms (X), boron atoms (B), oxygen atoms (O), nitrogen atoms (N), and carbon atoms (C), the substrate temperature, discharging power, etc. may be controlled.

In the present invention, as the diluting gas to be used in formation of the light receiving layer according to the glow discharge method or the sputtering method, so-called rare gases, such as He, Ne, Ar, etc. ma be preferably used.

In the following, an example of the method for preparation of a photoconductive member formed according to the glow discharge decomposition method is to be described.

Figure 3:
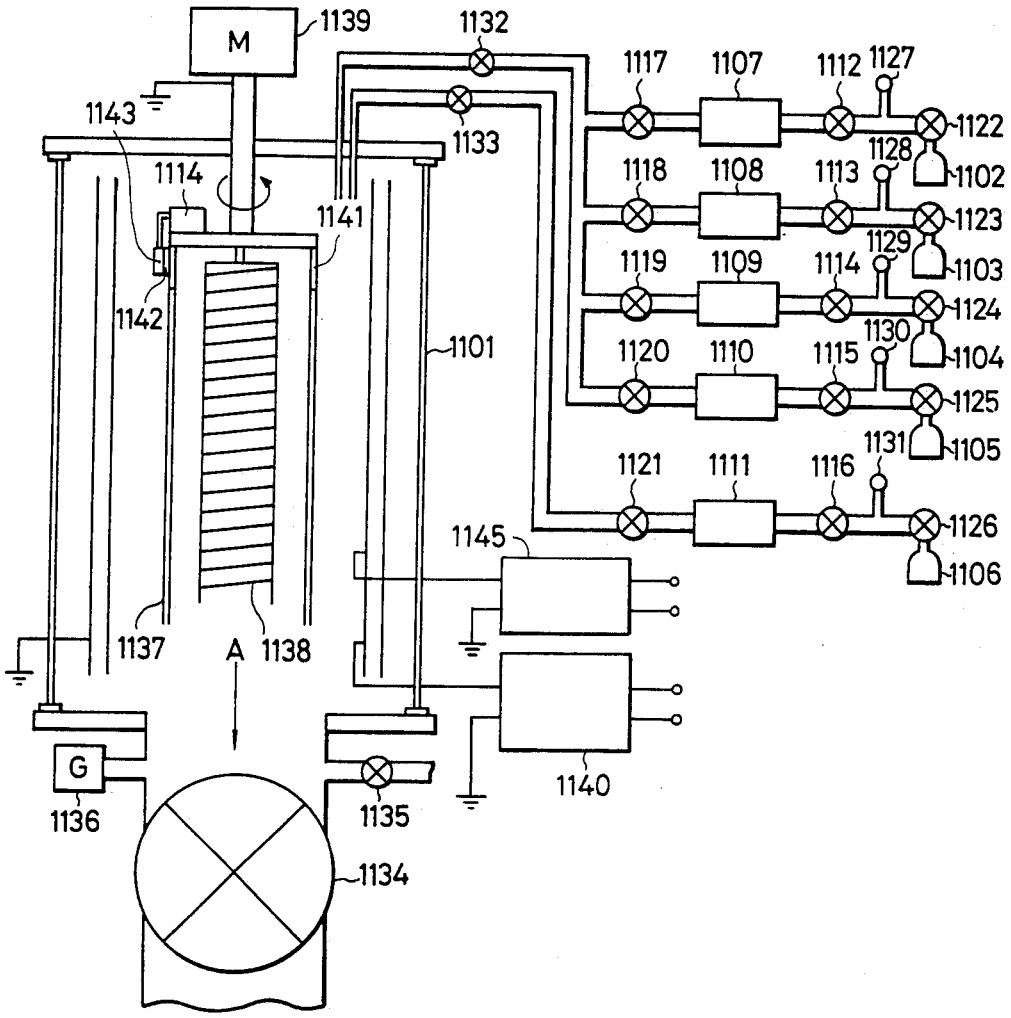
FIG. 3 is a schematic chart for illustration of a device for preparation of a photoconductive member according to the glow decomposition method.

FIG. 3 shows a device for preparation of a photoconductive member according to the glow discharge decomposition method.

In the gas bombs 1102–1106, there are hermetically contained starting gases for formation of the light receiving layer of the present invention. For example, 1102 is a $SiH_4$ bomb (purity: 99.99%), 1103 is a bomb containing $B_2H_6$ (purity: 99.99%) gas diluted with $H_2$ (hereinafter abbreviated as "$B_2H_6$/He"), 1104 is an NO gas bomb (purity: 99.99%), 1105 is a $CH_4$ gas bomb (purity 99.999%), and 1106 is an Ar gas bomb (purity: 99.999%). Other than these, although not shown in the drawing, it is also possible to provide additional bombs of desired gas species, if necessary.

For allowing these gases to flow into a reaction chamber 1101, on confirmation of valves 1122–1126 of the gas bombs 1102–1106 and a leak valve 1135 to be closed, and inflow valves 1112–1116, outflow valves 1117–1121 and auxiliary valves 1132 and 1133 to be opened, a main valve 1134 is first opened to evacuate the reaction chamber 1101 and gas pipelines. As the next step, when the reading on a vacuum indicator 1136 becomes about $10^{-6}$ Torr, the auxliary valves 1132 and 1133 and the outflow valves 1117–1121 are closed. Then, $SiH_4$ gas from the gas bomb 1102, $B_2H_6/H_2$ gas from the gas bomb 1103, NO gas from the bomb 1104, $CH_4$ gas from the gas bomb 1105, and Ar gas from the gas bomb 1106 are permitted to flow into mass-flow controllers 1107–1111, respectively, by controlling the pressures at outlet pressure gauges 1127–1131 to 1 $Kg/cm^2$, respectively, by opening the valves 1122–1126 and opening gradually inflow valves 1112–1116. Subsequently, the outflow valves 1117–1121 and the auxiliary valves 1132 and 1133 are gradually opened to permit respective gases to flow into the reaction chamber 1101. The outflow valves 1117–1121 are controlled so that the flow rate ratio of the respective gases may have a desired value and opening of the main valve 1134 is also controlled while watching the reading on the vacuum indicator 1136 so that the pressure in the reaction chamber may reach a desired value. And, after confirming that the temperature of a substrate cylinder 1137 is set at 50°–400° C. by a heater 1138, a power source 1140 is set at a desired power to excite glow discharge in the reaction chamber 1101.

At the same time, gas flow rates of the $B_2H_6/H_2$ gas and NO gas are suitably changed so that the desired distribution of the boron atom and oxygen atom contents previously designed may be obtained, and discharging power and the substrate temperature may be controlled, if desired, in the sense to compensate for the plasma conditions changed corresponding to the change in said gas flow rates, to form a photoconductive layer 102.

During the layer formation, in order to effect uniformization of layer formation, the substrate cylinder 1137 is preferably rotated at a constant speed by means of a motor 1139.

Next, all the valves of the gas operation system employed are closed and the reaction chamber 1101 is evacuated. When the reading on the vacuum indicator becomes about $1\times10^{-6}$ Torr, the outflow valve 1121 and the auxiliary valve 1133 are opened gradually to permit Ar gas to flow into the reaction chamber 1101. The flow rate of Ar gas is controlled to be a desired value by controlling the outflow valve 1121 and the opening of the main valve 1136 is controlled so that the pressure in the reaction chamber may become a desired value, while watching the reading on the vacuum indicator 1136. Then, the power source 1145 is set at a desired power to excite Ar ion bombardment in the reaction chamber 1101. By this operation, the surface of the photoconductive layer 102 and the inner surface of the reaction chamber 1101 are cleaned.

As the next step, all the valves of the gas operation system employed are closed and the reaction chamber 1101 is evacuated. During this operation, a shutter 1143 placed on a quartz glass 1142 for sampling of deposited film previously set on a dummy cylinder 1141 placed on the substrate cylinder 1137 is opened by means of an electromagnetic switch 1144. When the reading on the vacuum indicator 1136 becomes $1\times10^{-6}$ Torr, the same operation as described above is repeated, followed by opening of the operational valves of $SiH_4$ and $CH_4$ to control the flow rates of the respective gases to desired values, and glow discharging is excited similarly as described above to form the surface layer 103.

The present invention is described below by referring to the Examples.

Example 1

By means of the device shown in FIG. 3 a light receiving layer was prepared according the glow discharge decomposition method on a cylindrical aluminum substrate under the conditions shown in Table 1. The spin concentration of the a-SiC layer on the quartz glass for sampling of the deposited film obtained was determined by ESR to obtain the results a shown in Table 2. The photoconductive member thus obtained was set in an electrophotographic device and a latent image was formed by charging at a corona voltage of +6KV and an image exposure dose of 0.8 to 1.5 lux.sec, followed by the respective processes of developing, transferring, and fixing in conventional manner, and image evaluation was conducted. For image evaluation, image formation corresponding to the total number of 800,000 sheets was conducted with the use of papers of A4 size under ordinary environment, and further image formation corresponding to 150,000 sheets was conducted under high temperature and high humidity condition. For samples per 10,000 sheets, superiority and inferiority for respective images were judged with respect to density, resolution, gradation reproducibility, image defect, and the like. As the result, very good evaluations could be obtained with respect to all of the above items, regardless of the environment condititions and successive number of copying. In particular, a marked effect can be seen in the item of density and it was confirmed that a very high density could be obtained. This is also supported by the result of measurement of potential. For example, when compared with a sample in which no treatment is applied to the surface of the photoconductive layer, the acceptable potential was found to be improved by about 1.2 to 1.5-fold. Such an improvement of acceptable potential gives not only a high image density, but also a broad latitude of corona conditions to afford a great advantage of widened scope in choice of image quality.

Still another marked item is resolution, and it was found in the series of the present tests that very clear image could be maintained under any environmental condition.

The high durability and high quality images may be understood to be due to the effect of provision of the a-SiC with lower spin density as measured by ESR on the free surface side of the light receiving layer, and a distinct difference could be seen both under ordinary environment and under high temperature condition.

EXAMPLE 2 AND COMPARATIVE EXAMPLE 1

Drum-shaped photoconductive members were prepared according to the same procedure as in Example 1 except for changing the conditions for preparation of the surface layer 103 as shown in Table 3. For these photoconductive members, durability and image quality were evaluated similarly as in Example 1 to obtain the results as shown in Table 4.

EXAMPLE 3

Following the preparation conditions as shown in Table 5, a drum-shaped photoconductive member was prepared in the same manner as in Example 1. The spin density of the a-SiC forming the surface layer of the photoconductive member as measured by ESR was determined as shown in Table 6. For this photoconductive member, durability and image quality were evaluated in entirely the same manner as in Example 1. Good results similar to Example 1 could be obtained.

TABLE 1

| Order of lamination (layer name) | Gases and their flow rates (SCCM) | Gas pressure (Torr) | Discharging power (W) | deposition time (min.) |
|---|---|---|---|---|
| 1 (Photoconductive layer 102) | $SiH_4$: 300<br>$B_2H_6/H_2$*: 30 | 0.3 | 150 | 200 |
| 2 (Surface layer 103) | $SiH_4$: 15<br>$CH_4$: 500 | 0.48 | 100 | 3 |

*Gas diluted with $H_2$ to 1000 ppm of $B_2H_6$ conc.

TABLE 2

| Layer thickness (Å) | Spin density (spins/cm$^3$) |
|---|---|
| 1800 | $4.6\times10^{17}$ |

TABLE 3

| Example | Gases and their flow rates (SCCM) | Gas pressure (Torr) | Discharging power (W) | Deposition time (min.) |
|---|---|---|---|---|
| Example 2 | $SiH_4$: 30<br>$CH_4$: 700 | 0.68 | 150 | 3 |
| Comparative Example 1* | $SiH_4$: 20<br>$C_2H_6$: 700 | 0.66 | 150 | 3 |

*No Ar bombardment before deposition of the surface layer 103 was practiced.

TABLE 4

| Example | Comparative example 1 | Example 2 |
|---|---|---|
| Deposition time (min.) | 3 | 3 |
| Layer thickness (Å) | 2000 | 2400 |
| Spin density (spins/cm$^3$) | $5.1\times10^{21}$ | $1.7\times10^{18}$ |

TABLE 4-continued

| Example | Comparative example 1 | Example 2 |
|---|---|---|
| Image evaluation | Δ | O |

O: Very good

Δ: After successive copying for 10,000 times, images became slightly unfocused under high temperature (35° C.) and high humidity (90%)

TABLE 5

| Order of lamination (layer name) | Gases and their flow rates (SCCM) | Gas pressure (Torr) | Discharging power (W) | Deposition time (min.) |
|---|---|---|---|---|
| 1 (Charge injection impeding layer 104) | $SiH_4$: 300<br>$B_2H_6/H_2$*: 450<br>NO: 10.5 | 0.69 | 150 | 6 |
| 2 (Photoconductive Layer 105) | SiH: 300 | 0.25 | 150 | 150 |
| 3 (Surface layer 103) | $Si_2H_6$: 15<br>$CH_4$: 600 | 0.52 | 100 | 3 |

*Gas diluted with $H_2$ to 1000 ppm of $B_2H_6$ conc.

TABLE 6

| Layer thickness (Å) | Spin density (spins/cm$^3$) |
|---|---|
| 1800 | $3.2 \times 10^{17}$ |

What we claim is:

1. A photoconductive member, having a support and a photoconductive light receiving layer comprising a matrix of silicon atoms containing at least one of hydrogen atoms and halogen atoms provided on said support, said light receiving layer having a layer region with a layer thickness of at least 20 Å from the side of the free surface, in which the spin density measured by Electron Spin Resonance is $1.0 \times 10^{20}$ spins/cm$^3$ or less.

2. A photoconductive member according to claim 1, wherein the light receiving layer contains at least one of oxygen atoms, nitrogen atoms, and carbon atoms.

3. A photoconductive member according to claim 1, wherein the light receiving layer has a layer region containing a substance which controls conductivity.

4. A photoconductive member according to claim 3, wherein the substance which controls conductivity is an atom belonging to the group III of the periodic table.

5. A photoconductive member according to claim 3, wherein the substance which controls conductivity is an atom belonging to the group V of the periodic table.

6. A photoconductive member according to claim 1, wherein the light receiving layer comprises a photoconductive layer and a surface layer.

7. A photoconductive member according to claim 1, wherein the light receiving layer comprises a charge injection impeding layer, a photoconductive layer, and a surface layer.

8. A photoconductive member according to claim 6 or 7, wherein the surface layer has a thickness within the range of from 20 Å to 15 μm.

9. A photoconductive member according to claim 6 or 7, wherein at least one of boron atoms, oxygen atoms, nitrogen atoms, and carbon atoms is contained in the photoconductive layer.

10. A photoconductive member according to claim 9, wherein the minimum atom concentration of boron, oxygen, nitrogen, and carbon atoms is within the range of from 1 to $1 \times 10^3$ atomic ppm.

11. A photoconductive member according to claim 7, wherein at least one of boron atoms, oxygen atoms, nitrogen atoms, and carbon atoms is contained in the charge injection impeding layer.

12. A photoconductive member according to claim 11, wherein the maximum atom concentration of boron, oxygen, nitrogen, and carbon atoms is within the range of from 30 to $5 \times 10^4$ atomic ppm.

13. A photoconductive member according to claim 7, wherein the charge injection impeding layer has a layer thickness within the range of from 20 Å to 15 μm.

14. A photoconductive member according to claim 7, wherein the photoconductive layer has a layer thickness within the range of from 1 to 100 μm.

15. A photoconductive member according to claim 6 or 7, wherein the surface layer contains silicon atoms, hydrogen atoms, and/or carbon atoms, nitrogen atoms, oxygen atoms.

16. A photoconductive member according to claim 1, wherein the light receiving layer has a charge injection impeding layer.

17. A photoconductive member according to claim 1, wherein the light receiving layer has a surface layer.

* * * * *